United States Patent [19]

Flint

[11] 4,262,820

[45] Apr. 21, 1981

[54] HOT-MELT ADHESIVE DISPENSER

[76] Inventor: Theodore R. Flint, P.O. Box 513, Valley Forge, Pa. 19481

[21] Appl. No.: 939,399

[22] Filed: Sep. 5, 1978

[51] Int. Cl.[3] ..... B67D 5/62

[52] U.S. Cl. ..... 222/146 H; 222/341; 126/343.5 A; 126/231

[58] Field of Search ..... 222/146 R, 146 H, 146 HE, 222/326, 327, 341, 180, 181, 173, 475, 465; 431/253; 228/51, 53; 126/401, 413, 414, 229, 236, 231, 343.5 A; 401/1, 2

[56] References Cited

U.S. PATENT DOCUMENTS

| | | | |
|---|---|---|---|
| 131,684 | 9/1872 | Hyde et al. | 126/343.5 A |
| 1,888,403 | 11/1932 | Wester | 401/1 |
| 3,072,299 | 1/1963 | Sessions et al. | 222/181 |
| 3,228,566 | 1/1966 | Knox | 222/146 HE |
| 3,336,462 | 8/1967 | Fuller | 228/51 |
| 3,711,240 | 1/1973 | Warshaw | 431/253 |

FOREIGN PATENT DOCUMENTS

| | | | |
|---|---|---|---|
| 191776 | 1/1923 | United Kingdom | 126/343.5 A |

*Primary Examiner*—H. Grant Skaggs
*Attorney, Agent, or Firm*—Steele, Gould & Fried

[57] ABSTRACT

An applicator for hot melt adhesives. The applicator comprises a heat exchange barrel having a nozzle at one end and an opening at the other end for receiving a stick of hot melt adhesive, the barrel being attached to a cigarette lighter in heat transfer relation with its flame, so that when the adhesive stick is forced through the barrel in the presence of the flame, molten adhesive flows from the nozzle.

15 Claims, 16 Drawing Figures

HOT-MELT ADHESIVE DISPENSER

FIELD OF THE INVENTION

The present invention relates to hot-melt adhesive dispensers, and more particularly, the present invention relates to portable, hand-held tools for dispensing hot-melt adhesives.

BACKGROUND OF THE INVENTION

In recent years, so-called hot-melt adhesives have been developed for various uses. Customarily, such adhesives are heated to a molten state and flowed onto surfaces to be bonded together. The bond strength develops upon cooling of the molten adhesive to the solid state.

Although hot-melt adhesives are highly desirable, there are certain drawbacks to their use. For instance, the adhesives are customarily applied by means of a heating tool such as disclosed in the following U.S. Pat. Nos. 2,681,685; 3,443,059; 3,337,093; and 3,204,828. Since each of these tools employs an electrical heating element, the tools and the hot-melt adhesives are limited to use in environments where electrical power is readily available. Also, there are many applications, such as encountered by a homeowner do-it yourselfer, where hot-melt adhesives could be used but where the limited use does not justify the expense of an electrically-powered dispenser. Hence, a device which is capable of dispensing hot-melt adhesives without requiring electrical service is highly desirable.

In U.S. Pat. No. 3,970,395, there is disclosed a hot-melt adhesive with self-melting capabilities. In brief, this adhesive comprises a pyrotechnic core surrounded by adhesive in stick form so as to be hand-held. Thus, when the pyrotechnic core is ignited at one end, it generates sufficient heat to melt the surrounding adhesive which can be flowed onto a surface for subsequent bonding. Although the self-melting adhesive stick has certain advantages, there is a need for an applicator capable of dispensing hot-melt adhesive in conventional stick form.

OBJECTS OF THE INVENTION

With the foregoing in mind, it is a primary object of the present invention to provide a novel tool for melting conventional hot-melt adhesive sticks without requiring a source of electricity.

It is another object of the present invention to provide an improved portable device for heating and applying hot-melt adhesives.

As a further object, the present invention provides a unique hot-melt adhesive heating and applying device which is relatively inexpensive to manufacture and simple to use.

A still further object of the present invention is to provide a hot-melt adhesive dispenser which utilizes a conventional cigarette lighter as a heat source.

SUMMARY OF THE INVENTION

As a more specific object, the present invention provides a non-electric hot-melt adhesive dispenser. To this end, the dispenser comprises a handle having a hollow chamber adapted to contain a flammable fuel, valve means on the handle for releasing the fuel, means for igniting the released fuel to produce a localized source of heat, barrel means having a heat-exchange portion disposed in heat transfer relation with the heat source and having a nozzle at one end for dispensing a molten adhesive stick, so that when the stick is forced into the barrel while heat is being applied, the adhesive stick melts and flows from the nozzle for application onto a work surface.

BRIEF DESCRIPTION OF THE DRAWINGS

The foregoing and other objects, features and advantages of the present invention should become apparent from the following description when taken in conjunction with the accompanying drawings, in which.

DESCRIPTION OF THE PREFERRED EMBODIMENTS

Figure 1:
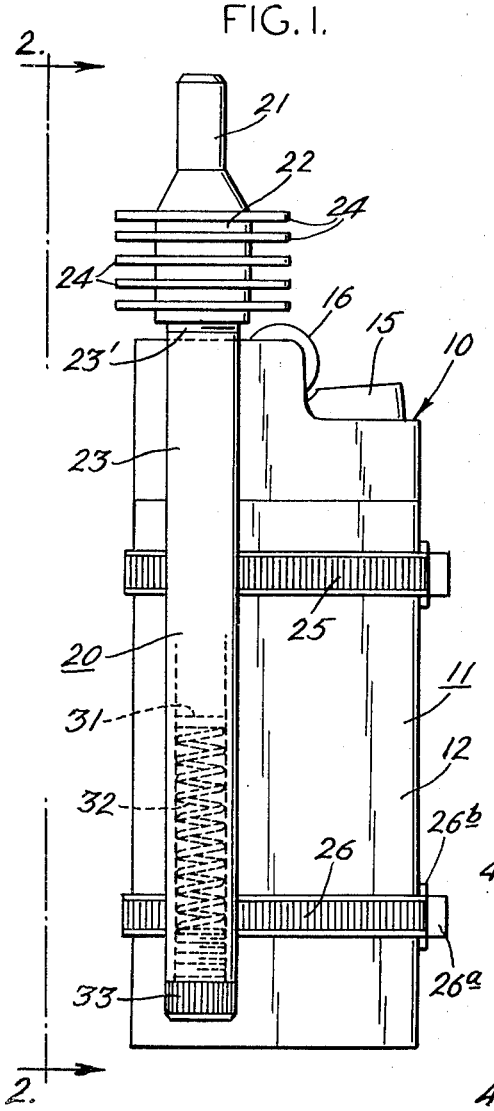
FIG. 1 is a side elevational view of one preferred embodiment of the present invention.

Referring now to the drawings, FIG. 1 illustrates a hot-melt adhesive dispenser 10 which embodies the present invention. As best seen therein, the dispenser 10 comprises a conventional cigarette lighter 11 sold under the trade designation "Super-Cricket" by the Gilette Company and barrel means 20 which cooperates with the lighter 11.

Figure 6:
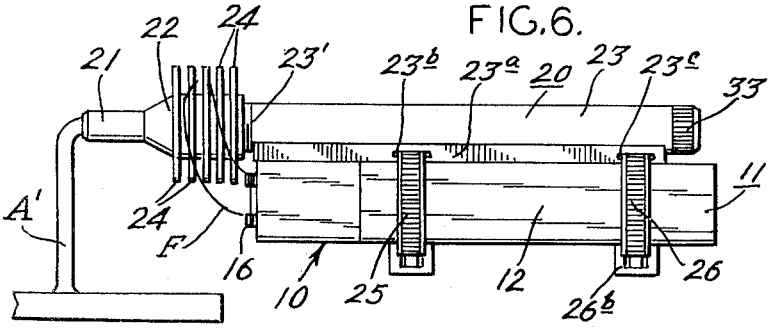
FIG. 6 is an end view in reduced scale illustrating the dispenser in use applying molten adhesive onto a work surface.

The cigarette lighter 11 is preferably of the so-called "butane" type and has a vertically-elongaged hollow body 12 with an orifice 13 (FIG. 2) at its upper end. The orifice 13 is opened and closed by a moveable valve member 14 operated by a valve actuator 15. A rotary ignitor means 16 is provided for cooperating with a flint (not shown) to ignite fuel released from the orifice 13 in a well-known manner to produce a flame (FIG. 6).

Figure 2:
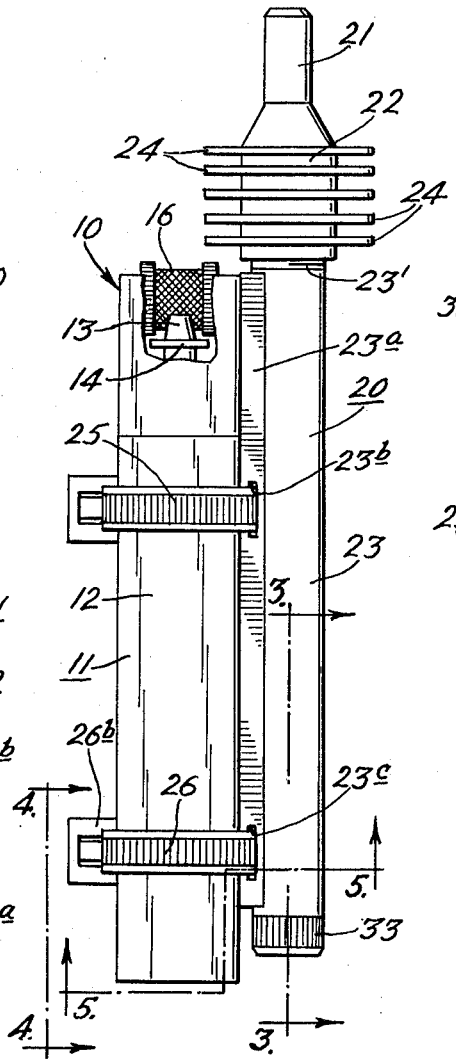
FIG. 2 is an end elevational view taken on line 2—2 of FIG. 1.
Figure 3:
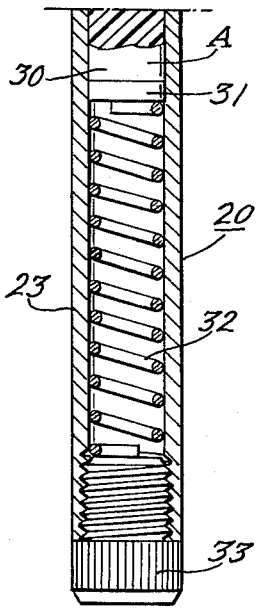
FIG. 3 is an enlarged sectional view taken on line 3—3 of FIG. 2.

The barrel means 20 cooperates with the lighter 11 to contain, melt and dispense a stick of a hot-melt adhesive A. In the embodiment illustrated in FIGS. 1–6, the barrel means 20 has a nozzel portion 21, a heat exchanger 22 adjacent the nozzle, and an elongated receiver portion 23 extending lengthwise along substantially the entire length of the body 12 of the lighter 11. As best seen in FIG. 1 and 2, the heat exchanger 22 has a series of annular fins 24 spaced apart axially along its length to increase the surface area and thereby to improve the transfer of heat to the adhesive A. Preferably, the nozzle 21 and the heat exchanger 22 are fabricated from a metal having good heat transfer capabilities, such as copper, aluminum or the like. The receiver 23, on the other hand, is preferably die cast from a material having a lower thermal condutivity, such as zinc, in order to limit the amount of heat conducted into the receiver 23 for preventing premature melting of the adhesive stick. This also protects the lighter 11 and protects the person using the dispenser against inadvertantly getting burned while grasphing the dispenser 10. Preferably, the upper end 23' of the receiver 23 is threaded into the inside of the heat exchanger 22 to afford assembly of the unit and disassembly for cleaning of the interior of the heat exchanger 22 and the nozzle 21.

Figure 4:
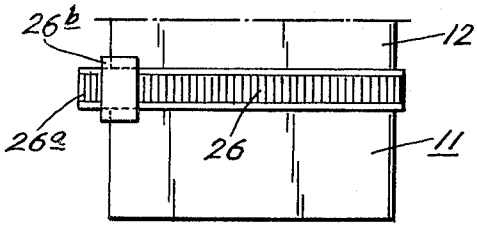
FIG. 4 is a fragmentary side elevational view taken on line 4—4 of FIG. 2.
Figure 5:
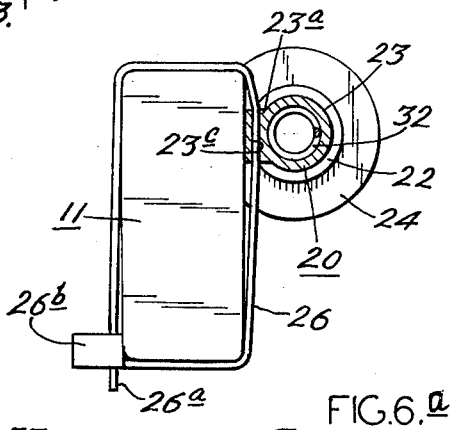
FIG. 5 is a sectional view taken on line 5—5 of FIG. 2.
Figure 6A:
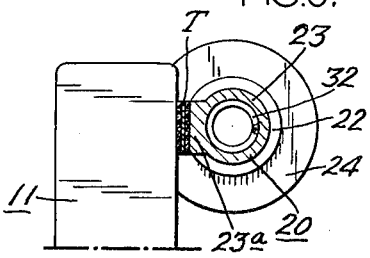
FIG. 6*a* is a fragmentary end view in reduced scale illustrating a double face adhesive tape interposed between the receiver and the container.

The barrel means 20 is fastened to the cigarette lighter 11 so that the heat exchanger 22 is disposed in heat transfer relation with a flame when the lighter 11 is activated. To this end, the underside of the barrel 23 is provided with a longitudinally-extending base or flat 23*a*, and a pair of slots 23*b* and 23*c* are molded in spaced relation in the base 23*a*. A pair of tie strips 25 and 26 extend through the slots 23*b* and 23*c*, respectively, and surround the lighter body 12 at spaced axial locations in the manner illustrated in FIGS. 1 and 2. As best seen in FIG. 4, the tie strip 26 is of conventional plastic construction and has a free end 26*a* which passes through a one-way latch block 26*b* having an interior latch (not shown) that cooperates with external detents on the strip 26 to secure the same when pulled leftward through the latch block 26*b*. Thus, the barrel means 20 may be installed readily on a lighter 11 with a minimum of effort and experience on the part of the person using the same. If desired, adhesive means including a double-faced adhesive tape T may be interposed between the barrel base 23*a* and the lighter body 12 to mount the barrel in proper operating relation in lieu of the strip means illustrated. See FIG. 6*a*.

The molten adhesive A' is forced positively from the end of the nozzle 21. For this purpose, means is provided in the receiver 23 to engage the outer end 30 of the adhesive stick A to force the adhesive continuously inwardly to the heat exchanger 22 as the adhesive A melts upon application of heat to the heat exchanger 22. In the embodiment illustrated in FIGS. 1–6, the pressure applying means includes a follower 31 which engages the outer end of the adhesive stick A. A helical compression spring 32 is provided in the receiver 23 and engages between the follower 31 and a knurled cap 33 threaded into the outer end of the receiver 23. Preferably, the follower 31 is brazed or otherwise fastened to the end of the compression spring 32 so that it can be withdrawn with the compression spring 32 after the cap 33 has been removed and prior to insertion of a new length of adhesive stick A into the outer end of the receiver 23. The length of the adhesive stick A is selected to accommodate the spring 32 when fully compressed against the cap 33. Thus, the compression spring 32 functions to maintain pressure against the adhesive stick A to force the same continuously through the heat exchanger 22 and thence in a molten state out of the nozzle 21 when heat is applied to the heat exchanger 22.

In order to ensure proper heat exchange relation between the heat exchanger 22 and the flame produced by the lighter 11, the heat exchanger 22 is mounted adjacent the orifice 13 at the upper end of the lighter body 12 in such a manner as to cause the flame F to impinge upon the fins 24 when the valve operator 15 is depressed and the ignitor 16 actuated, and the lighter body 12 is disposed horizontally as illustrated in FIG. 6 to dispense molten adhesive A' from the end of the nozzle 21. The fins 24 cooperate to stabilize the flame F so that it resists extinguishment by stray air currents while at the same time improving the rate of heat transfer from the flame F to the adhesive stick A inside the heat exchanger 22. Thus, molten adhesive A' can be dispensed easily by the average person simply by holding the lighter 11 horizontally in the manner illustrated in FIG. 6 while simultaneously maintaining the valve actuator 15 depressed to cause the flame F to impinge on the fins 24.

Although the barrel means 20 may be continuously connected to the lighter 11, it may be removed and installed whenever it is needed. It is noted, however, that the fins 24 are located laterally of the fuel orifice 13 so that the lighter 11 can be used in the customary manner for lighting cigarettes or the like even with the barrel means 20 installed on the lighter 11.

A modified embodiment of the present invention is illustrated in FIGS. 7–11. For the sake of clarity, the same reference numerals used in the embodiment of FIGS. 1–6 will be used to designate like parts in this embodiment; however, the numerals are preceeded by the numeral "1".

Figure 7:
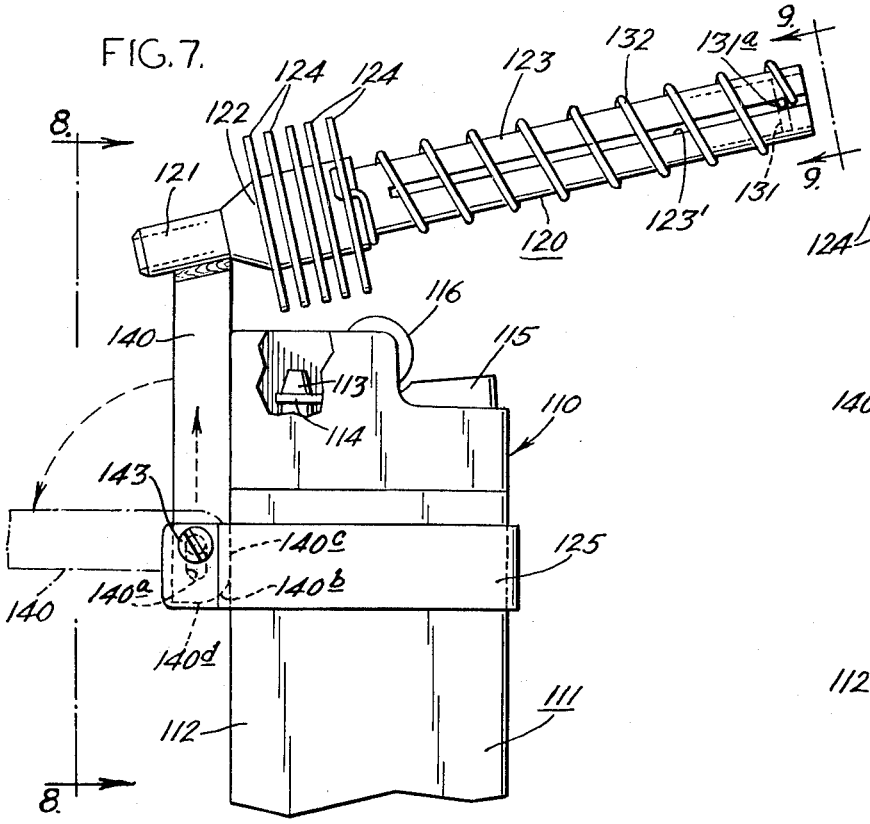
FIG. 7 is a fragmentary side elevational view of a modified embodiment of the present invention.
Figure 8:
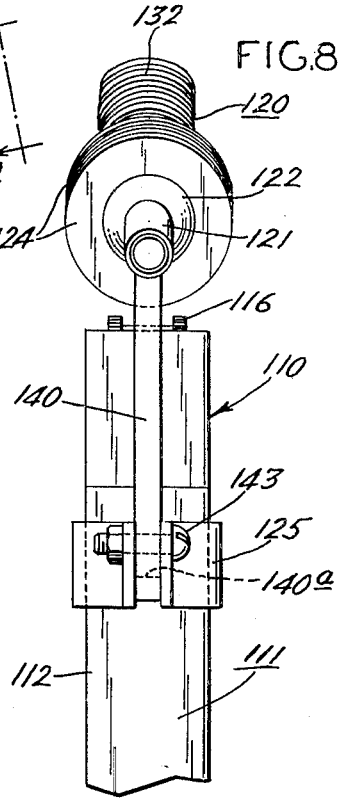
FIG. 8 is an end elevational view taken on line 8—8 of FIG. 1.
Figure 9:
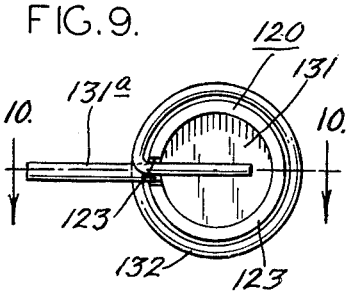
FIG. 9 is an enlarged end view taken on line 9—9 of FIG. 7 to illustrate the outer end of the barrel.
Figure 10:
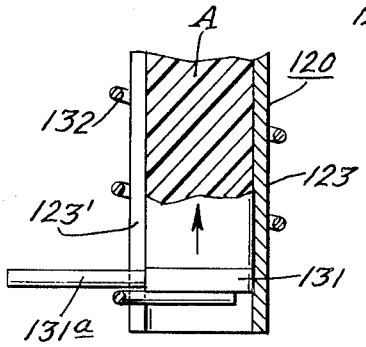
FIG. 10 is a fragmentary sectional view taken on line 10—10 in FIG. 9.
Figure 11:
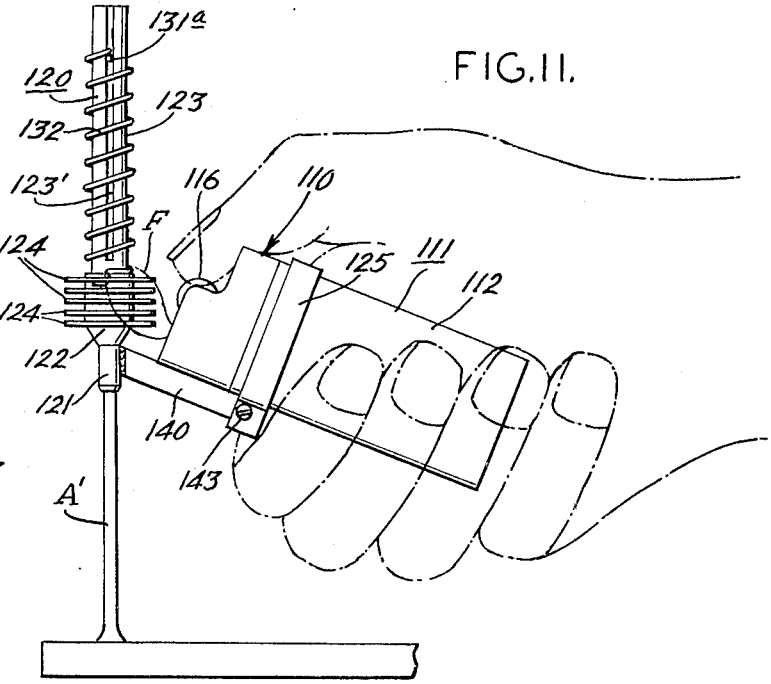
FIG. 11 is a view in reduced scale illustrating the dispenser in use applying molten adhesive onto a work surface.
Figure 12:
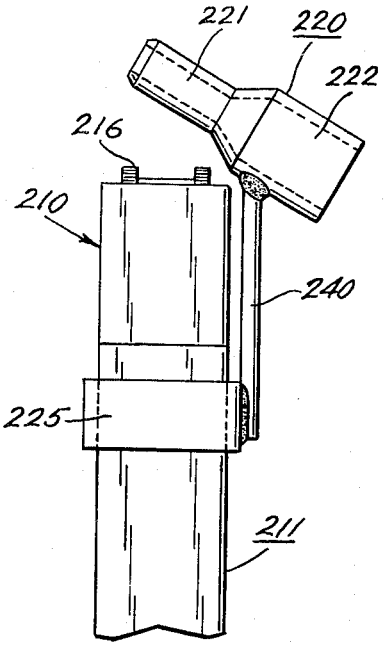
FIG. 12 is a fragmentary end elevational view of a further modified embodiment of the present invention.
Figure 13:
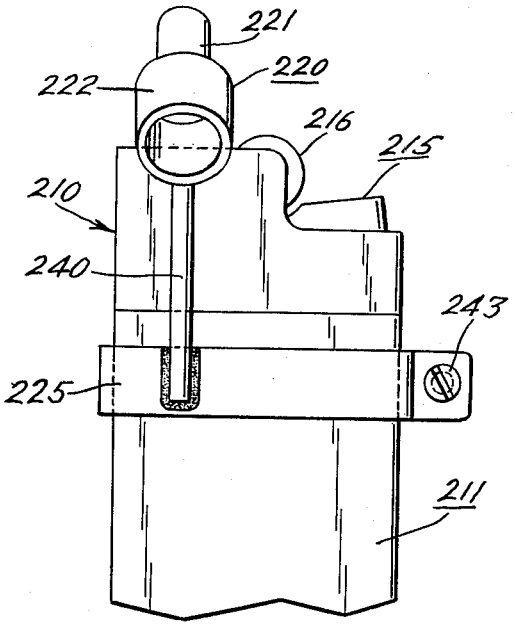
FIG. 13 is a fragmentary side elevational view thereof.

Referring now to FIG. 7, the dispenser 110 includes a cigarette lighter 111 and barrel means 120 associated therewith for containing, heating and dispensing molten adhesive A' in the manner illustrated in FIG. 11. The barrel means 120 includes a nozzle 121, a heat exchanger 122 with fins 124 and a receiver 123. As in the preceeding embodiment, continuous inward pressure is applied to the adhesive stick A in the receiver 123 by means of a helical extension spring 132 having its inner end hooked into a hole in the outer one of the heat exchanger fins 124 and having its outer end fastened to a follower 131 adapted to engage the outer end of a hot-melt adhesive A contained in the receiver portion 123 of the barrel means 120. As best seen in FIG. 7, the receiver 123 has a longitudinal slot 123' which slidably receives a finger grip 131*a* of the follower 131. The finger grip 131*a* not only provides a visible indication of the amount of adhesive in the receiver 123 but also enables the spring 132 to be extended and disengaged with the follower 130 from the outer end of the receiver 123 to afford insertion of the adhesive stick A into the outer end of the receiver 123.

As best seen in FIG. 7, the barrel means 120 is disposed above the top of the lighter 111 in inclined relation with the heat exchanger portion 122 located closely adjacent the fuel valve 114 so as to be in the heat transfer relation with the flame produced. The upwardly inclined disposition of the barrel means provides space above the valve actuator 115 to accommodate the thumb or fingers of the user when the dispenser 110 is in use. See FIG. 7.

The barrel means 120 is mounted to the lighter 111 in such a manner as to enable it to be swung out of the way to rotate the ignitor wheel 116. To this end, a link 140 depends from the underside of the nozzle 121 and extends along the front end of the lighter 111. The lower end of the link 140 is sandwiched between the ends of a rigid strap 125 which embraces the lighter body 111 adajcent its upper end. A bolt 143 extends through the ends of the strap 125 and the link 140 to mount the link 140 (and hence the barrel means 120) to pivot from an active position above the lighter 111 to an inactive position laterally of the lighter 111.

In order to secure the barrel means 120 in its operating position as illustrated in FIGS. 7 and 11, latch means is provided. In the present instance, the latch means includes a vertically elongated slot 140*a* in the lower end of the link 140 and a radiused edge 140*b* connecting the vertical inside edge 140*c* of the link 140 to its bottom edge 140*d*. The surface 140*c* is located relative to the bolt 143 so as to prevent the link 140 from pivoting counterclockwise when the link 140 is slid downwardly along the front of the lighter 111 and the upper end of the slot 140*a* engaged against the bolt 143. The radiused surface 140*b*, however, permits the link 140 to be pivoted about the bolt 143 after it has been pulled upwardly and the lower end of the slot engaged with the bolt 143. The bottom edge 140*c* of the link is engaged with the front of the lighter 111 to support the link 140 laterally with respect to the lighter 111 as seen in FIG. 7.

To flow molten adhesive A′ from the nozzle 121 onto a workpiece, the user grips the lighter 111 with one hand and establishes the flame F in the usual manner. The barrel means 120 is then latched in position with the heat exchanger above the flame F. Preferably, the lighter 111 is held upright for a few seconds to allow the heat from the flame F to flow upwardly between the fins to preheat the adhesive before the lighter 111 is tilted to dispose the nozzle downwardly for flowing the molten adhesive A′ onto the work surface. Of course, the user can vary the intensity of the heat applied to the heat exchanger 122 by regulating thumb pressure on the valve actuator 115.

A still further modified embodiment is illustrated in FIGS. 12–15. In this embodiment (where like numerals are used to denote like parts) the means for forcing the adhesive stick A through the heat exchange barrel 222 has been eliminated. Thus, the adhesive stick A must be pushed downwardly with thumb or finger to flow molten adhesive from the nozzle 221.

Figure 15:
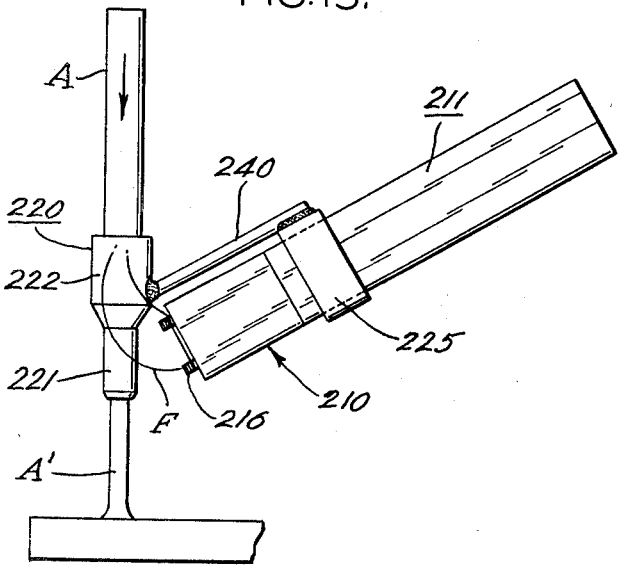
FIG. 15 is a view in reduced scale illustrating the dispenser in use.
Figure 14:
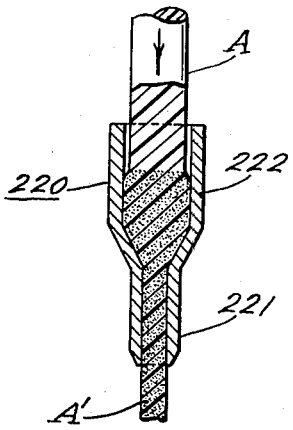
FIG. 14 is a sectional view of the heat exchange barrel.

As in the preceeding embodiment, the heat exchange portion 222 of the barrel means is disposed in heat transfer relation with the flame F produced when the lighter 211 is actuated and tilted as in the act of dispensing adhesive. For this purpose, the nozzle portion 221 of the barrel extends transversely across the flame F with the heat exchanger portion 222 being located somewhat alongside the lighter body. See FIG. 12. Preferably the barrel means 220 is brazed to a link 240 which in turn is brazed to a strap 225 which surrounds the lighter 111 and is secured by means of a bolt 243. Thus, when the lighter 211 is tilted so that its top is located adjacent the work surface as illustrated in FIG. 15, the flame F curls upwardly and impinges along the length of the heat exchanger 222. As best seen in FIG. 14, the inside diameter of the heat exchanger 222 is slightly greater than the diameter of the nozzle 221 to provide additional surface area for promoting heat transfer.

In view of the foregoing, it should be apparent that the present invention now provides a portable hot-melt adhesive dispenser which is inexpensive to manufacture and easy to use.

While preferred embodiments of the present invention have been described in detail, various modifications, alterations and changes may be made without departing from the spirit and scope of the present invention as defined in the appended claims.

I claim:

1. A hot-melt adhesive dispenser comprising:

an elongated portable hand-held container means for containing a fuel and having a discharge orifice at one end;

valve means on said container means for cooperating with said orifice to release said fuel;

means on said container means adjacent said valve means for igniting fuel released from said container means to produce a flame;

an elongated barrel disposed alongside and carried by said container means, said barrel having a nozzle for flowing molten adhesive and a heat exchanger adjacent said nozzel; and, strap means surrounding said container means for mounting said container means to said barrel with said heat exchanger disposed adjacent said orifice, so as to be in heat transfer relation with said flame, and off-set from said valve means at the top of the container means.

2. A hot-melt adhesive dispenser according to claim 1 including a receiver extending outwardly from said heat exchanger for containing a length of adhesive stick, and means carried by said receiver for cooperating therewith to apply pressure to the outer end of the adhesive stick for advancing the same into the heat exchanger as molten adhesive flows from the nozzle.

3. A hot-melt adhesive dispenser according to claim 2 wherein said pressure applying means includes a follower slidably mounted in said receiver and spring means connected to said follower for urging the same inwardly toward said heat exchanger.

4. A hot-melt adhesive dispenser according to claim 3 wherein said receiver means has an open outer end mounting a removeable cap, and said spring means includes a compression spring disposed in said receiver between said follower and said cap to apply said pressure.

5. A hot-melt adhesive dispenser according to claim 2 wherein said receiver is fabricated of a material having lower thermal conductivity than the material of said nozzle and heat exchanger to limit substantial heat transfer from said nozzle and heat exchanger thereby preventing premature melting of the adhesive stick in the receiver.

6. A hot-melt adhesive dispenser according to claim 1 wherein said barrel means is mounted to said container means with said heat exchanger overlying said orifice when said container means is disposed in a generally vertical position.

7. A hot-melt adhesive dispenser according to claim 1 wherein said heat exchanger is disposed transversely in inclined relation with respect to said container means so that the flame impinges on the heat exchanger when the container is disposed with its upper end downward to dispense molten adhesive from said nozzle.

8. A hot-melt adhesive dispenser, for use in combination with a cigarette lighter having a hollow elongated handle containing a flammable fuel, a valved orifice at one end of said handle for releasing said fuel, and an igniter on the handle adjacent the valved orifice for producing a flame when actuated, the hot-melt adhesive dispenser, comprising: an elongated barrel means adapted to contain a length of a hot-melt adhesive stick while being heated, said barrel having a nozzle at one end for flowing molten adhesive, a heat exchanger adjacent said nozzle, and a receiver at its other end for supporting a length of hot-melt adhesive in its solid state strap, means connecting said barrel means alongside said handle so that the heat exchanger is disposed in heat transfer relation with the flame and means releasably clamping said connecting means to said handle so that the heat exchanger is disposed in heat transfer relation with said flame when the handle is positioned with the nozzle disposed downwardly, whereby the heat from the flame causes adhesive to melt in the heat exchanger and to flow from the nozzle.

9. Apparatus according to claim 2 wherein said receiver is adapted to slidably receive said hot-melt adhesive stick, and further comprises a follower slidably received in said receiver and spring means connected to said follower for urging the stick inwardly toward the nozzle as the stick is melted in the heat exchanger.

10. A hot-melt adhesive dispenser comprising:

a portable hand-held container means for containing a fuel and having a discharge orifice at one end;

valve means on said container means for cooperating with said orifice to release said fuel;

means on said container means adjacent said valve means for igniting fuel released from said container means to produce a flame;

a barrel carried by said container means, said barrel having a nozzle for flowing molten adhesive, a heat exchanger adjacent said nozzle and a receiver extending outwardly from said heat exchanger for containing a length of adhesive stick;

means carried by said receiver for cooperating therewith to apply pressure to the outer end of the adhesive stick for advancing the same into the heat exchanger as molten adhesive flows from the nozzle, said receiver means having an elongated slot, a follower, having a finger grip slidably received in said slot, and spring means, for urging the follower inwardly toward said heat exchanger including an extension spring having its inner end anchored adjacent the inner end of said receiver and having its outer end engaged with said follower, said follower and outer spring end being removeable from the outer end of said receiver to afford insertion of the adhesive stick; and, means for mounting said barrel to said container with said heat exchanger disposed adjacent said orifice so as to be in heat transfer relation with said flame.

11. A hot-melt adhesive dispenser comprising:

a portable hand-held container means for containing a fuel and having a discharge orifice at one end;

valve means on said container means for cooperating with said orifice to release said fuel;

means on said container means adjacent said valve means for igniting fuel released from said container means to produce a flame;

a barrel carried by said container means, said barrel having a nozzle for flowing molten adhesive and a heat exchanger adjacent said nozzle; and, means for mounting said barrel to said container with said heat exchanger disposed adjacent said orifice and projecting upwardly above the level of said orifice so that the flame impinges upon the heat exchanger when the container means is disposed in a generally horizontal position.

12. A hot-melt adhesive dispenser according to claim 11 wherein said barrel mounting means includes a link and bracket assembly mounting said barrel to said container means to afford pivotal movement of said barrel from an active position adjacent said heat source to an inactive position affording actuation of said igniter means, and means latching said link in said active position.

13. A hot-melt adhesive dispenser according to claim 12 wherein said latching means includes a slotted pivot connection between said link and bracket to dispose said link alongside the outside of said container means when in the active position and to afford said pivotal movement of said barrel upon combined upward and outward pivotal motion.

14. A hot-melt adhesive dispenser according to claim 11 wherein said barrel mounting means includes a double-faced adhesive tape interposed between said receiver and said container means.

15. A hot-melt adhesive dispenser comprising:

a portable hand-held container means for containing a fuel and having a discharge orifice at one end;

valve means on said container means for cooperating with said orifice to release said fuel;

means on said container means adjacent said valve means for igniting fuel released from said container means to produce a flame;

a barrel carried by said container means, said barrel having a nozzle for flowing molten adhesive and a heat exchanger adjacent said nozzle, said heat exchanger including a series of axially-spaced radially-extending fins; and, means for mounting said barrel to said container with said fins of said heat exchanger extending into proximity with said orifice so as to be impinged by said flame.

* * * * *

UNITED STATES PATENT AND TRADEMARK OFFICE

CERTIFICATE OF CORRECTION

PATENT NO. : 4,262,820

DATED : April 21, 1981

INVENTOR(S) : Theodore R. Flint

It is certified that error appears in the above-identified patent and that said Letters Patent are hereby corrected as shown below:

| | |
|---|---|
| Col. 3, line 13 | "condutivity" should be --conductivity--. |
| Col. 3, line 18 | "grasphing" should be --grasping --. |
| Col. 7, line 7 | after "state" insert -- , --. |
| Col. 7, line 8 | after "strap" delete " , ". |
| Col. 7, line 17 | delete " 2 " and insert -- 8 --. |

Signed and Sealed this

*Twenty-ninth* Day of *September 1981*

[SEAL]

*Attest:*

GERALD J. MOSSINGHOFF

*Attesting Officer*

*Commissioner of Patents and Trademarks*